United States Patent [19]

Franks, Jr.

[11] Patent Number: 4,886,946

[45] Date of Patent: Dec. 12, 1989

[54] SLIDE SWITCH WITH AN EXTENDIBLE ACTUATOR

[76] Inventor: George J. Franks, Jr., 664 Thompson Cir., Inverness, Ill. 60067

[21] Appl. No.: 242,635

[22] Filed: Sep. 9, 1988

[51] Int. Cl.[4] ..... H01H 15/24

[52] U.S. Cl. ..... 200/329; 200/547; 200/550

[58] Field of Search ..... 200/547, 549, 550, 342, 200/345, 329, 333

[56] References Cited

U.S. PATENT DOCUMENTS

| | | | |
|---|---|---|---|
| 3,674,953 | 7/1972 | Brevick | 200/550 X |
| 3,723,692 | 3/1973 | Wilbrecht | 200/302.1 |
| 3,757,060 | 9/1973 | Ianuzzi et al. | 200/16 C |
| 4,012,608 | 3/1977 | Lockard | 200/16 D |
| 4,332,987 | 6/1982 | Hoffman | 200/16 D |
| 4,376,234 | 3/1983 | Liataud et al. | 200/16 R |
| 4,628,166 | 12/1986 | Bingo et al. | 200/302.1 |

OTHER PUBLICATIONS

Miniature Slide Switches, Senior Industries, Inc.

*Primary Examiner*—Renee S. Luebke
*Attorney, Agent, or Firm*—Jenner & Block

[57] ABSTRACT

An electrical slide switch contains an extendible actuator mechanism. The actuator mechanism is initially flush with the housing, in an inactive position, and can be extended outwardly from the housing and locked in an active switching position after the switch is inserted into a printed circuit board. The actuator is movable along a guide ramp from the inactive position to the active position in which the actuator button and control carrier are locked together for further movement.

21 Claims, 5 Drawing Sheets

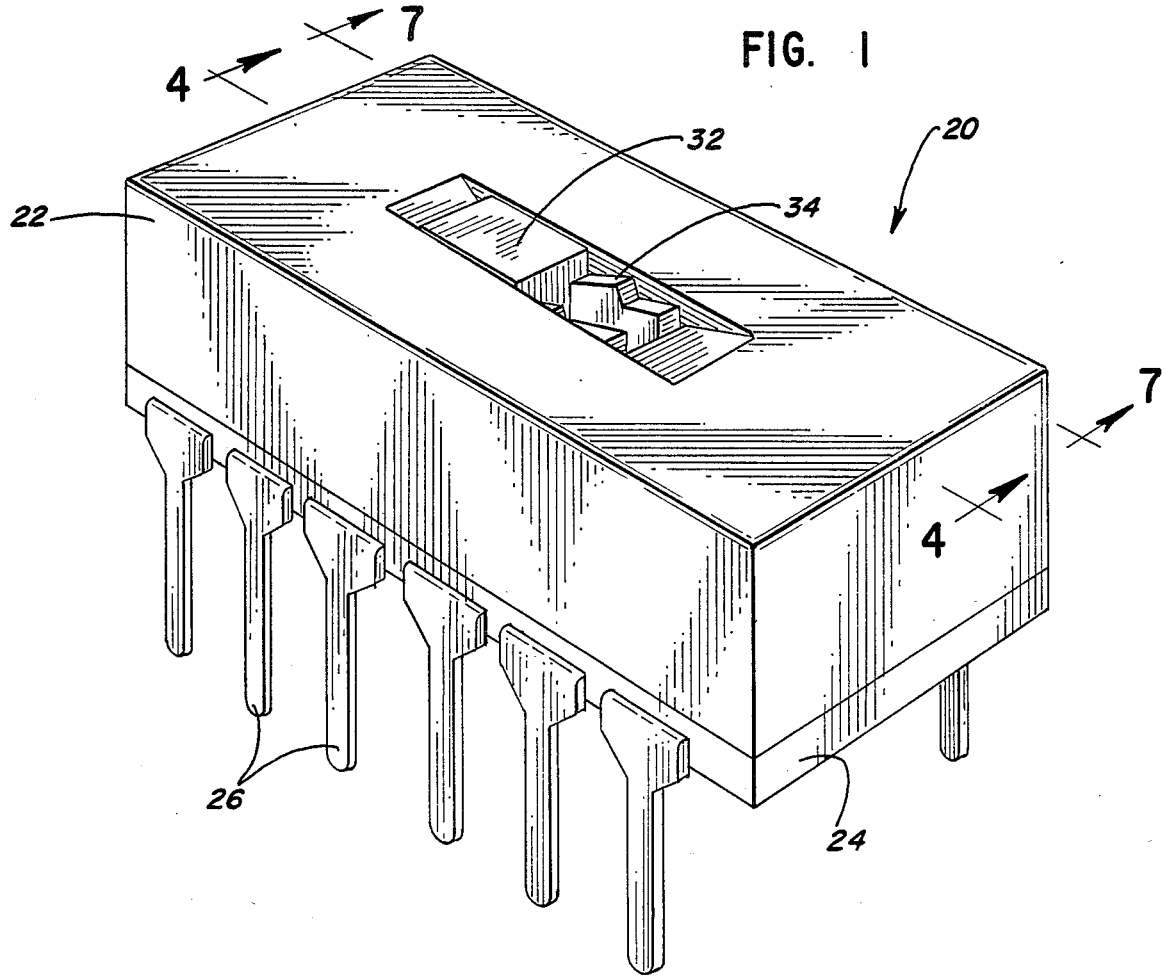
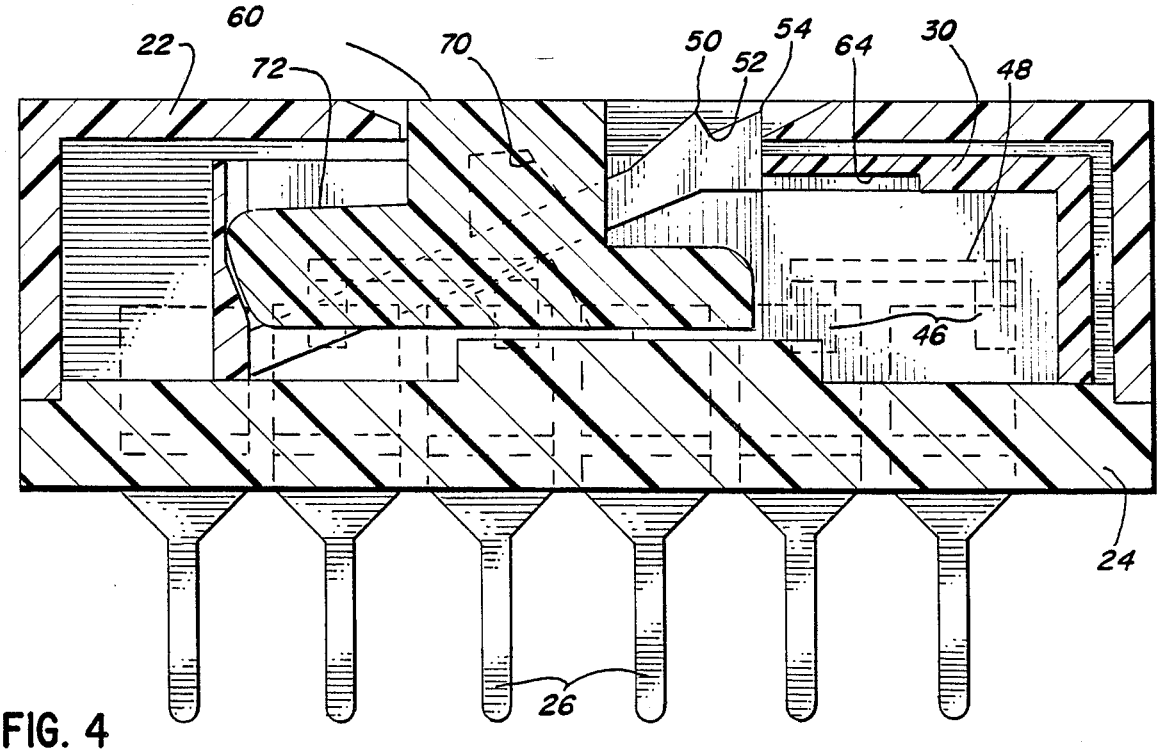
FIG. 4

20

FIG. 3
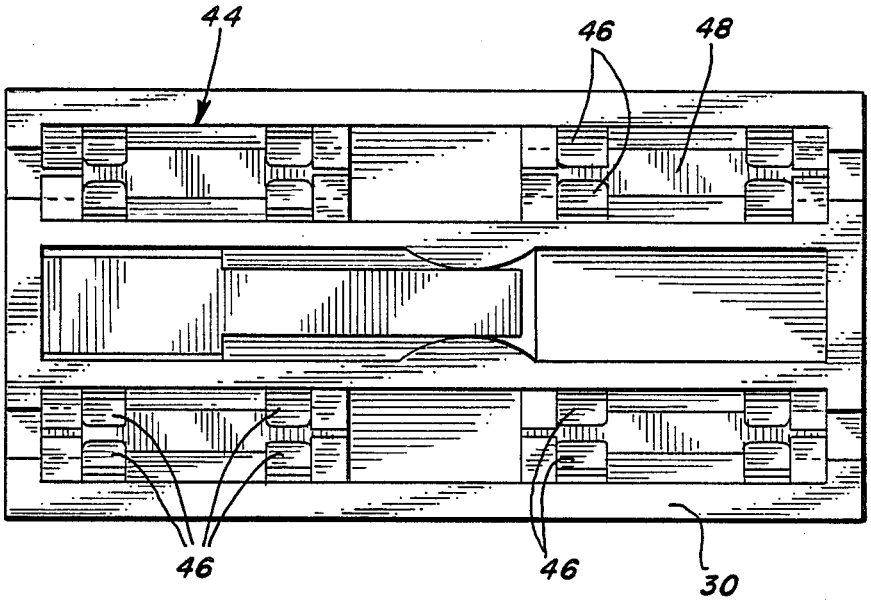
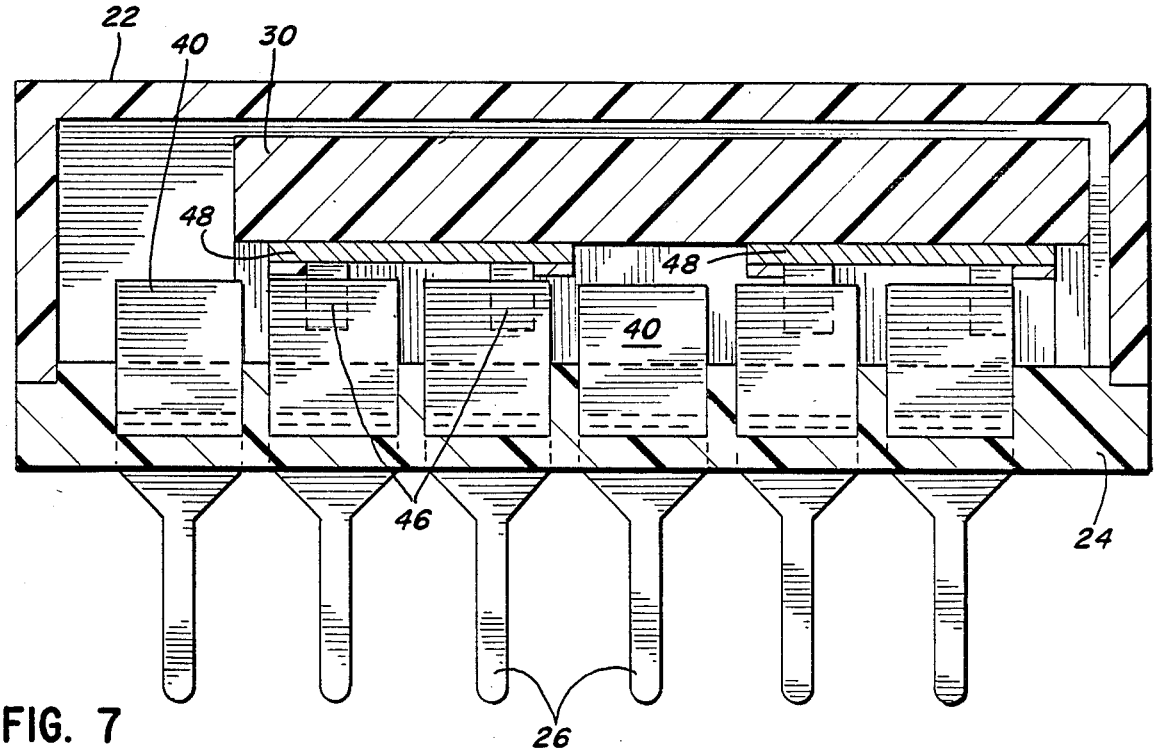
FIG. 7

FIG. 5
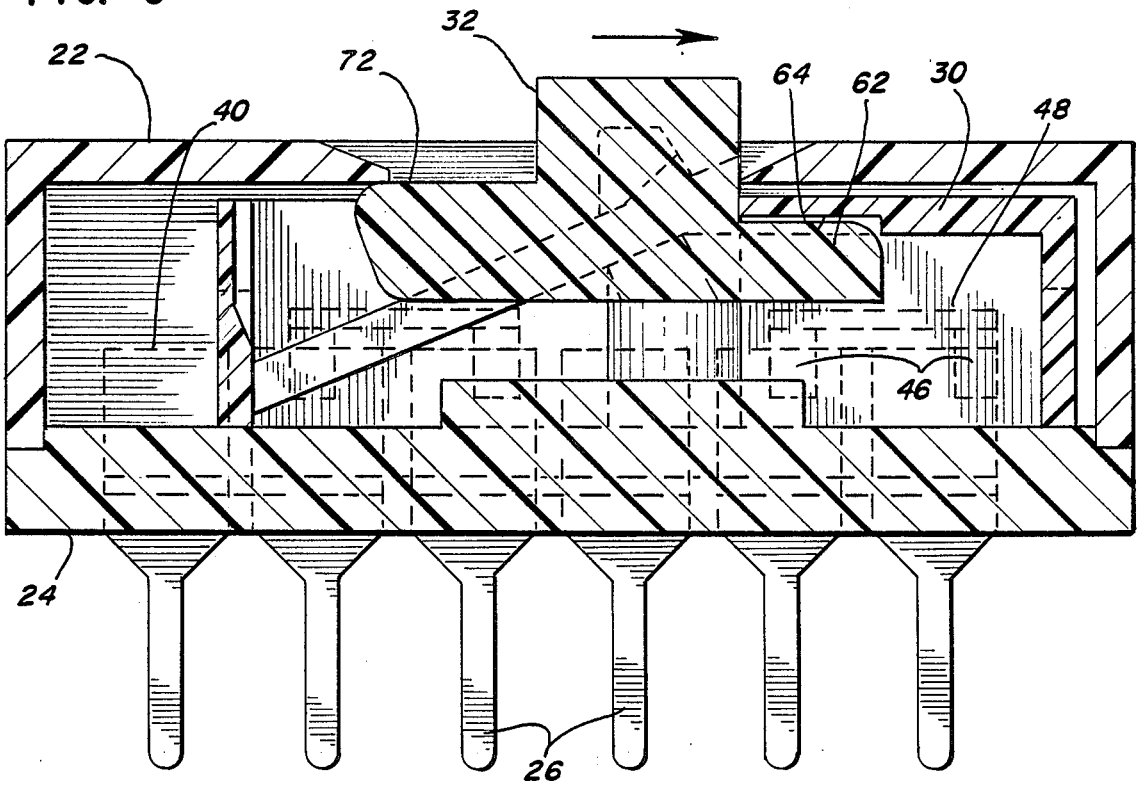
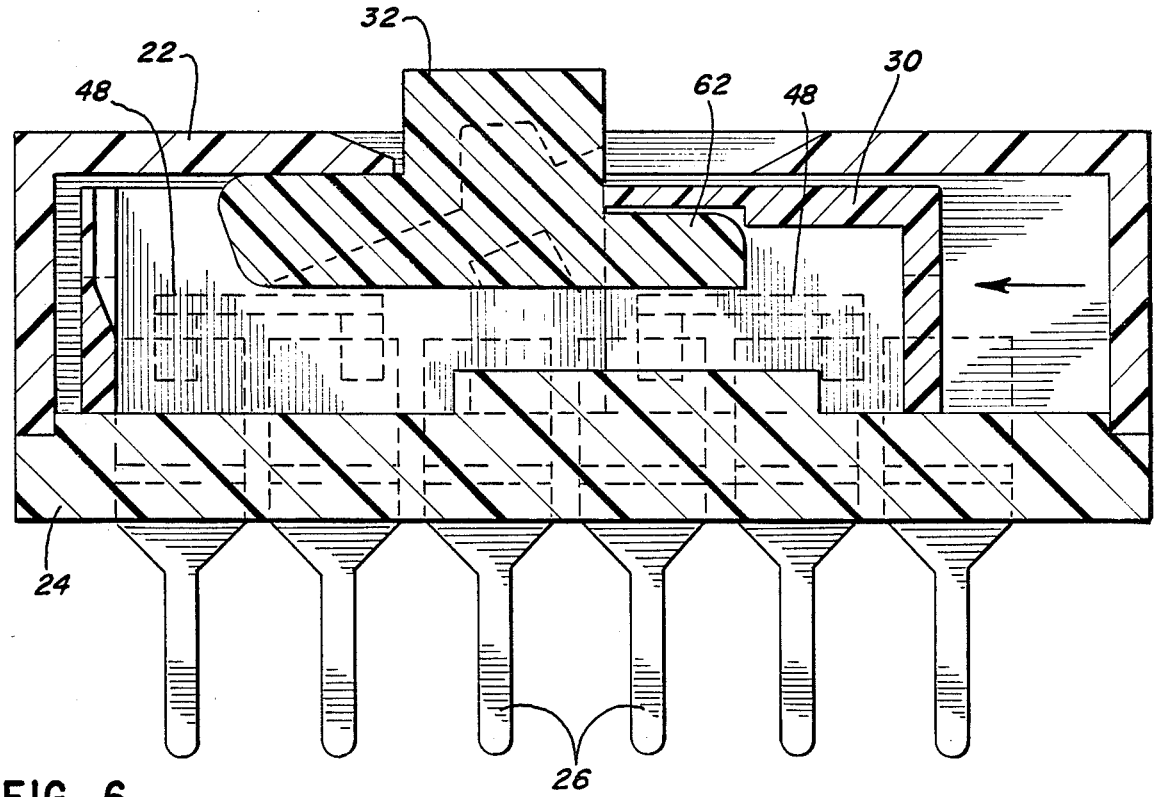
FIG. 6

SLIDE SWITCH WITH AN EXTENDIBLE ACTUATOR

FIELD OF THE INVENTION

This invention relates generally to an electrical switch having an extendible actuator. In specific embodiments, the switch is provided with an actuator mechanism which is initially flush with the switch housing and which is selectively extendible outwardly from the housing for ease of use, such as after the slide switch is inserted in a printed circuit board.

BACKGROUND OF THE INVENTION

Miniature electrical switches are used in numerous applications where space is confined or limited, such as on a printed circuit board. While the size of the switch is greatly reduced, it is still necessary that the actuator button be readily movable by a person's finger to different switch positions. Particularly with a slide switch, this has been difficult to accomplish.

These slide switches typically have multiple positions for one or more sliding contacts, as is known to those skilled in the art. For example, the slide switch may contain switch contacts extending from a contact carrier to bridge individual pins extending below the switch. The individual pins are then inserted into the printed circuit board and soldered, or the switch is otherwise attached to the printed circuit board.

The contact carrier may contain an actuator button or gripping knob that permits manual movement of the carriage between selected positions. In certain designs, the actuator is flush with the top of the slide switch housing for insertion into a printed circuit board by an automatic insertion machine.

Contamination of the slide switch by dust and other particles can occur before and during assembly of the printed circuit. If the actuator is flush with the top surface of the housing, at least a portion of the top surface may be covered with tape, providing a simple, effective way to prevent contamination. However, to effectively use such tape, the actuator must be flush with the top surface so that the tape can seal all dust and particle entry around the actuator.

After the printed circuit is assembled, the tape is removed from the top surface and the actuator can be moved as desired to move the carriage between different positions. However, movement of the actuator is difficult since the top of the switch is flush with the top surface of the switch. Moving the actuator may require a special tool. A switch construction is therefore desirable which prevents contamination during the assembly process, but which allows easy movement of the actuator after the assembly process is completed without the need of either specialized labor or tools.

SUMMARY OF THE INVENTION

In accordance with the present invention, a slide switch with a novel actuator is provided. The actuator is located in an inactive position flush with an outer surface of the switch during insertion of the slide switch into a printed circuit board, and is extendible at a later time after the assembly process into an active position extending outwardly from the switch housing.

During insertion into a printed circuit board, the surface of the switch which contains the actuator channel is covered by tape. The actuator is located flush with this surface, in its first, inactive position. The actuator is, in the first position, resting along a guide formed on the switch carriage.

After insertion, a human operator pushes, with a finger or tool, the actuator along the guide and over at least one locking tang or boss into a second, locked position which extends outwardly from the surface of the switch. In its second position, the actuator is operative and coupled to the carriage. The actuator is thereby extended outwardly past the top surface of the slide switch to permit easy manual manipulation by the finger of the human operator.

Thus, in accordance with one object of the invention, a slide switch is provided that includes an actuator mechanism that can be placed in an inactivated flush position with a surface of the slide switch and which can be extended outwardly therefrom and placed in an operative position after the switch is mounted for use. The slide switch may be inserted by automatic insertion equipment into a printed circuit board, with the actuator being later extended for ease of use. The actuator can be pulled over locking tangs or bosses into an extended position.

Other objects and advantages of the invention will become apparent upon the following detailed description with reference to the drawings, where like reference numerals refer to like parts.

BRIEF DESCRIPTION OF THE DRAWINGS

FIG. 1 is a perspective view of one embodiment of the switch having a top mounted actuator;

FIG. 3 is a bottom view of the contact carrier shown in FIG. 2;

FIG. 4 is a side sectional view along the lines 4—4 of FIG. 1 illustrating the initial, inactive position of the actuator;

FIG. 5 is a side sectional view similar to FIG. 4 but illustrating an initial locked, active position for the actuator;

FIG. 6 is a side sectional view similar to FIG. 5 but illustrating the actuator having been moved to a second active position;

FIG. 7 is a side sectional view along the lines 7—7 in FIG. 1 illustrating the stationary contacts and carriage sliding contacts;

DESCRIPTION OF THE DETAILED EMBODIMENT

As seen in FIGS. 1–7, a miniature electrical switch 20 includes a cover 22 which tightly fits over a switch base 24 having a plurality of stationary contacts or pins 26 insertable into a printed circuit board. After insertion into the printed circuit board, the pins may be soldered to the board. Alternatively, the pins 26 can be bent at a right angle (not shown) for surface mounting of the miniature switch in a conventional manner.

Figure 2:
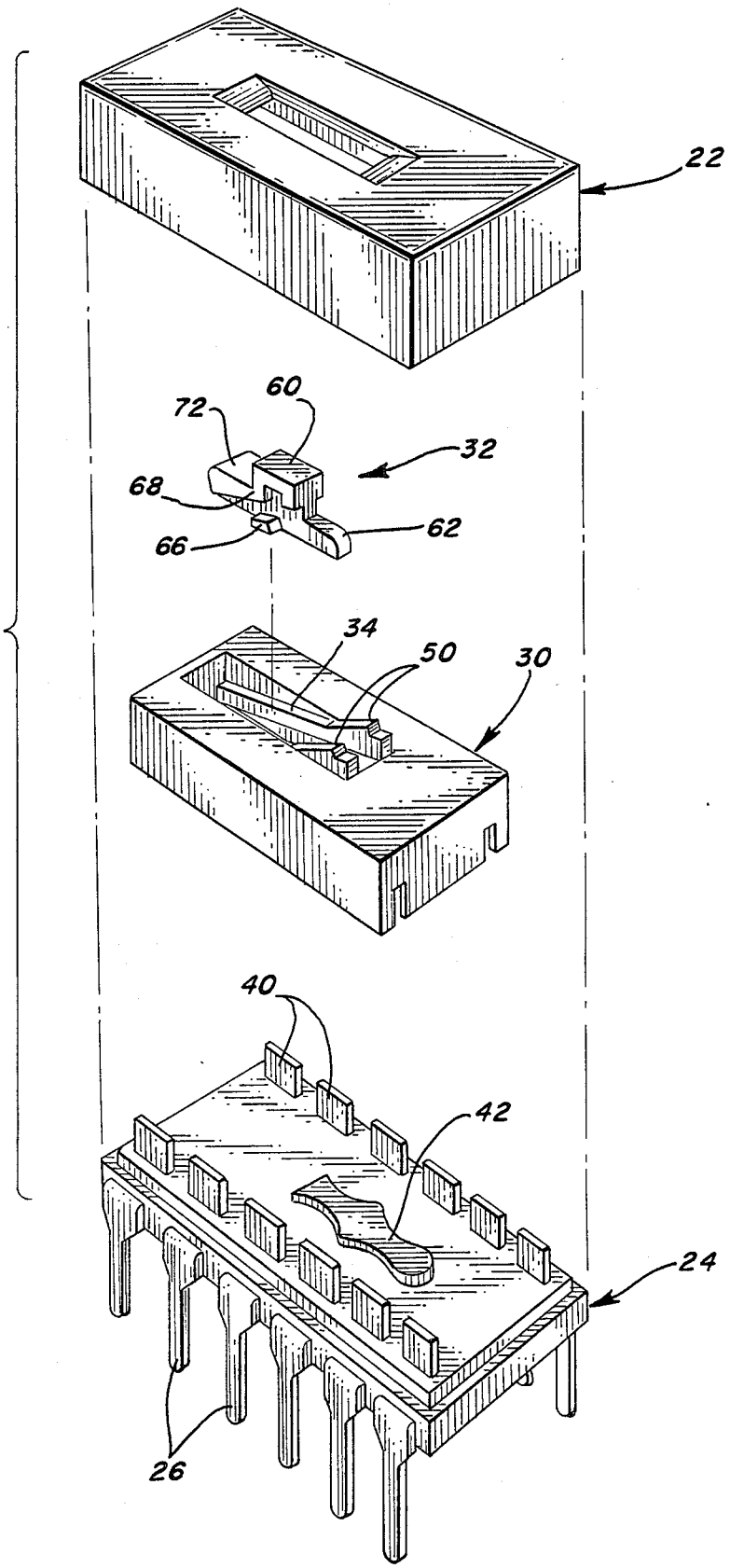
FIG. 2 is an exploded, perspective view of the embodiment in FIG. 1.

A switch contact carrier 30, see FIG. 2, is movably mounted relative to the base 24 and is movable to different positions in order to make and break electrical connections between the stationary contact pins 26. A switch button actuator 32 is initially located in an inactive, lowered position which is not coupled to the contact carrier 30. After the switch 20 is inserted in a printed circuit board or is otherwise mounted, the actuator 32 is movable along a pair of guide ramps 34 which are fixedly mounted to the contact carrier 30. The actuator 32 moves up the ramps into an active position in which the actuator 32 is locked for movement with the contact carrier 30. In the initial inactive position, seen in FIG. 4, the top surface of the actuator button 32 is located flush with the top surface of the cover 22. When the actuator is slid upwardly along the guide ramps 34, it locks into an active position seen in FIG. 5 in which the top surface of the actuator button extends above the surface of the switch cover 22 for ease of manipulation by a human's finger or with a tool. In this locked, active position, further movement of the actuator button 32 now slides the contact carrier 30 between different switching positions, as seen for example in FIG. 6. Thus, the actuator in its active position is easy to manipulate in order to change the position of the slide switch.

After construction of the switch, and before insertion into a printed circuit board, a tape (not shown) may be placed on the top surface of the cover 22 in order to prevent dust and other contaminants from entering the inside of the switch. The actuator is located in its inactive, flush position at this time as seen in FIG. 4. Because the actuator 32 is flush with the top of the switch cover, the slide switch is stackable and more readily handled by automatic insertion equipment for a printed circuit board. After the switch has been inserted into a printed circuit board and soldered or otherwise connected thereto, the tape may be easily removed and, at the same time, the actuator 32 urged to the right as seen in FIG. 5 so as to slide up the guide ramps 34 into the locked, active position seen in FIG. 5. The switch is now activated and ready for use. Further movement of the actuator will now cause the actuator 32 and contact carrier 30 to slide together and thereby make and break the switch contacts located therein.

The individual components which form the switch 20 will now be explained in more detail. As seen in FIG. 2, the switch base 24 contains a plurality of stationary contact pins 26 which may be insert molded in position. Each pin has an upstanding stationary contact 40 which contacts, as will appear, the wipers of the contact carrier 30 in order to make and break the individual switch contacts. A detent island 42 engages the bottom surface of the contact carrier 30, see FIG. 3, in a conventional manner so as to form several detent positions for the contact carrier.

The slideable contact carrier 30 has four sets of wiper contacts 44 seen best in FIGS. 3 and 7. Each movable wiper contact 44 consists of a pair of spring clips 46 which extend downwardly from a metal base 48 secured to the contact carrier 30. Each base 48 connects the adjacent pairs of spring clips 46 so that, as seen in FIG. 7, the spring clips press against the upright stationary contacts 40 in order to form an electrical connection between one pair of uprights 40 and the adjacent pair of uprights 40. As seen best by comparing FIGS. 5 and 6, the wiper contacts can be moved to break the initial electrical connection and form a different electrical connection. In the present situation, two pairs of double pole, double throw switches are formed as will be apparent to those skilled in the art. However, the circuit configuration is shown by means of illustration only and any circuit configuration standard in the art may be formed including single pole and double pole switches, single throw and double throw switches, various combinations thereof as well as more complex switching arrangements.

The pair of guide ramps 34, seen best in FIGS. 2 and 4, are molded into the sides of the contact carrier 30 adjacent an open center channel for the actuator button 32. As seen in FIG. 4, each guide ramp 34 slopes upwardly from a rear position to a locking peak 50, then slopes downwardly to a locking recess 52 and again slopes upwardly to a final peak 54. The shape of the peak 50, recess 52 and peak 54 fits a complementary shape in the actuator 32, as will appear, in order to snap the actuator into its activated position.

The actuator button 32, seen best in FIG. 2, is a separate molded piece designed for simple molding in which the mold may open sideways to release the part. Carrier 32 includes a top portion 60 having a gripping surface, such as by ridges formed therein, which is designed to be manipulated by the human finger. The center portion of the actuator 32 is of reduced size and includes a forward protruding nose 62 which is designed to engage a recess 64, see FIG. 4, formed in the top of the carrier 30, when the actuator is extended upwardly as seen in FIG. 5. At the base of the protruding nose 62 are a pair of side flanges 66, shown exaggerated in size, which may be snap fit through the tracks 34 in order to aid in retaining the actuator along the tracks. Above the side flanges are a pair of top flanges 68 which form the guide surface for guiding the actuator along the ramps 34. The bottom surface of the top gripping platform 60 includes a downwardly sloping locking face 70, FIG. 4, which is complementary to the slope between the peak 50 and recess 52 on the guide ramp 34 to snap fit over the locking peak 50, into the position seen in FIG. 5. A rear section 72 of the actuator 32 extends sufficiently to cover the opening in the cover 22, see FIG. 5, when the actuator is extended upwardly along the ramp. This prevents foreign matter and contaminants from gaining entry into the interior of the switch when the actuator is in its locked, active position.

As seen in FIGS. 5 and 6, once the actuator is slid along the ramp into its locked position, further movement in the opposite direction now causes the locking face 70 to be urged against the slope between the locking peak 50 and the locking recess 52, causing the actuator to be slid to the left as illustrated in FIG. 6 to its next switch position. While two switch positions have been illustrated, it will be apparent that the slide switch is capable of multiple switching configurations. Other modifications will be apparent to those skilled in the art.

Figure 8:
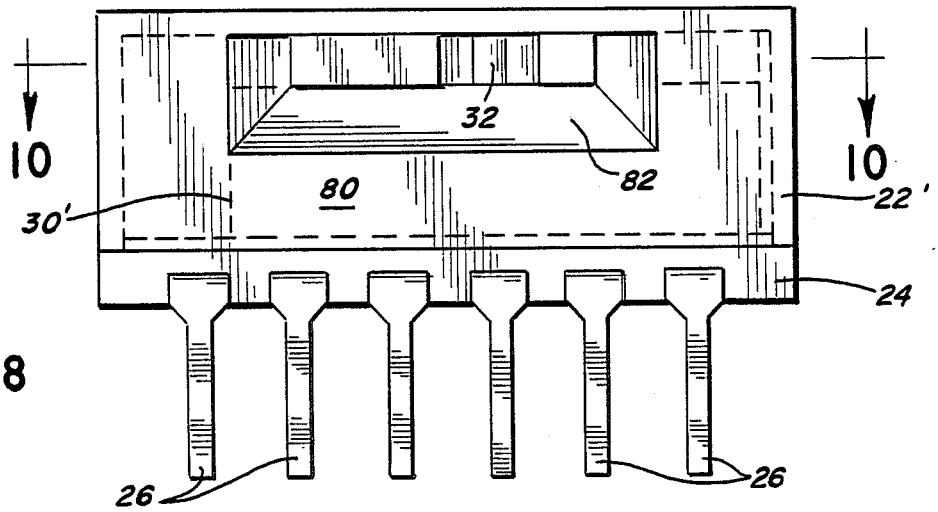
FIG. 8 is a side view of another embodiment of the switch having a side mounted actuator.
Figure 9:
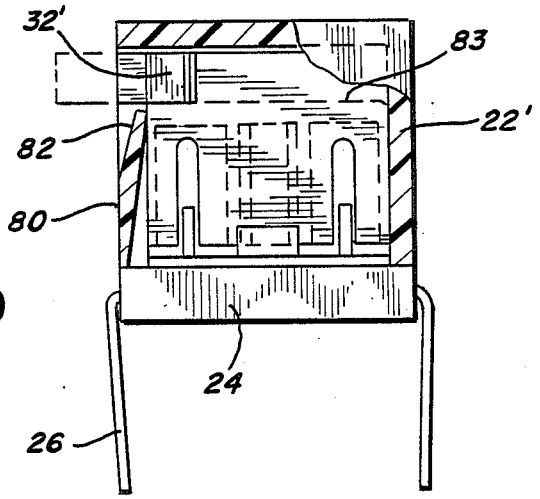
FIG. 9 is an end view, partly in section, of the switch of FIG. 8.
Figure 10:
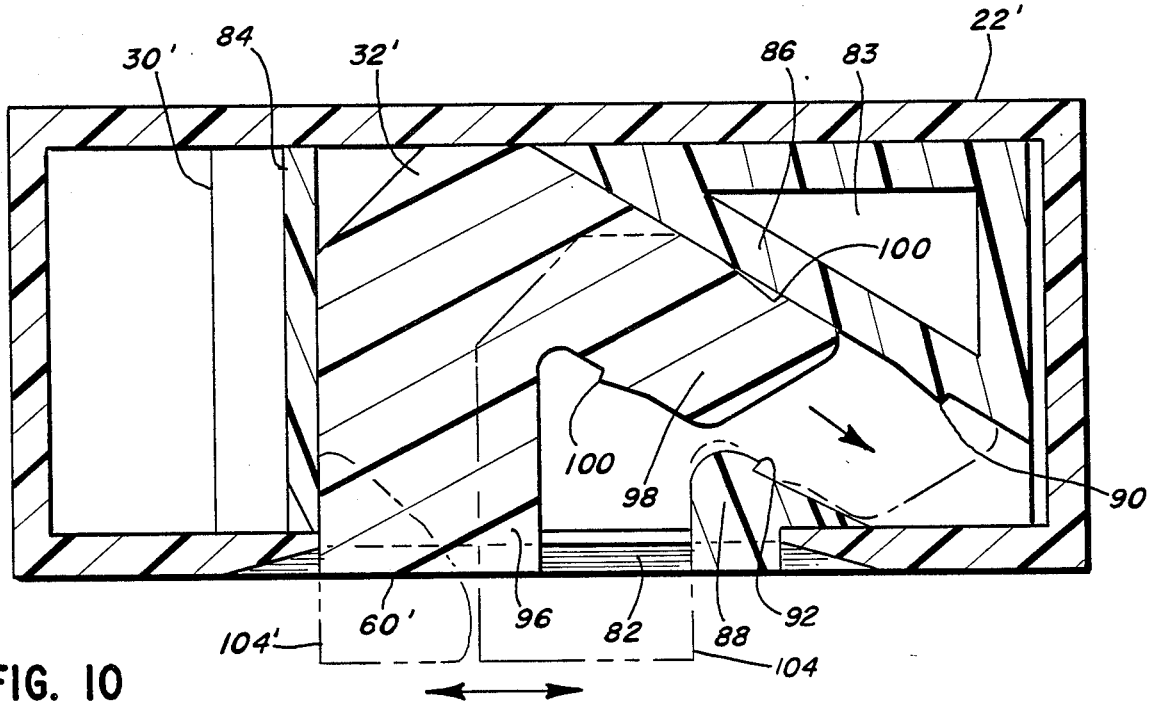
FIG. 10 is top sectional view along the lines 10—10 of FIG. 8 showing an enlarged view of the side mounted actuator.

In FIGS. 8–10, an alternate embodiment of the invention is illustrated in which the actuator is side mounted to the switch. In this embodiment, components which are the same as the previously described components have been identified with the same reference numerals, and certain components which are modified in construction are indicated by the same reference numeral followed by a prime.

The cover 22' has a solid top surface, with one side wall 80 having a sloping inward portion 82, FIG. 9, which terminates in an elongated opening for an actuator button 32'.

The actuator button 32' is slideably mounted on a solid top surface 83 of the contact carrier 30'. Extending above the top surface of the carrier 30' is a wall or rib 84, see FIG. 10, which helps contain the actuator when it is in an inactive position as illustrated in FIG. 10. A first angular rib 86 is spaced from a second angular rib 88, both of which are molded into the top surface 83 of the contact carrier 30', and defined therebetween a channel for movement of the actuator button. The angular rib 86 contains a locking peak 90, and the angular rib 88 contains a locking peak 92, both of which serve the function of locking or snap fit tabs for the actuator button, as will appear.

Actuator button 32' consists of a main body 96 which terminates in the gripping surface 60, and an arcuate section 98 extending at an angle therefrom and having a pair of locking tangs 100 molded into the body 98. As the actuator button 32' is urged to the right as shown in FIG. 10, the angular body 98 bears against the angular rib 86 and moves outwardly into an extended position as illustrated by the dashed lines 104. In this position 104, the locking tangs 100 snap fit over the locking peaks 90, 92 in order to connect the actuator button 32' to the carrier 30'. In this active position, the actuator button 32' and carrier 30' are locked together and now move as an integral unit. When the actuator button is next urged to the left as seen in FIG. 10, it moves to the position 104' shown by dashed lines and thus moves the contact carrier 30' to the left to a new switching position. As in the previous embodiment, the actuator 32' is initially in an inactive position, and extends outwardly with respect to the flush surface of the housing 22' into an active, coupled position for ease of manipulation after the switch has been mounted for use.

The electrical contacts within the carrier 30' are sealed from dust and contamination by the solid top surface 83. Although dust can enter the space between the actuator button 32' and the side channel, the actuator button mechanism slides and locks on top of a sealed contact carrier. Thus, both embodiments serve to seal the electrical contacts from contamination otherwise entering through the channel for the actuator button.

The materials of the switch may be of any standard or conventional form. By way of example, the actuator may be formed of Delrin or Celcon, and the switch base may be formed of a glass filled thermoplastic resin to allow the printed circuit contacts to be insert molded therein. Other materials used for miniature switches are also usable.

While the invention has been described in connection with preferred embodiments, it will be understood that the invention is not limited to these embodiments. On the contrary, it is intended to cover all alternatives, modifications and equivalents as may be included in the spirit and scope of the invention as described by the appended claims.

What is claimed is:

1. A switch, comprising:

a housing containing circuit contact means and an open channel through the housing;

carriage means selectively movable within the housing, the carriage means including means for selectively completing or breaking an electrical path between the circuit contact means; and an actuator movable with respect to said carriage means between a lowered position in which said actuator is not coupled to said carriage means and being extendable upwardly through the open channel to extend beyond an outer surface of the housing to a switching position in which the actuator is coupled to the carriage means and the actuator extends sufficiently beyond the outer surface of the housing to allow manual movement of the actuator and said carriage means between at least two switching positions.

2. The switch of claim 1 wherein the actuator is substantially flush with the outer surface of the housing in the lowered position.

3. The switch of claim 1 further comprising complementary locking means on the carriage means and the actuator to allow the actuator to be snap locked in the switching position.

4. The switch of claim 1 wherein the housing includes means for sealing the circuit contact means from contamination entering the housing through the open channel when the actuator is in the switching position.

5. A switch, comprising:

a housing having a base, sidewall surfaces and an upper surface with respect to the base, said housing containing a channel extending through one of the surfaces, the base having electrical contact means thereon;

a movable carriage within the housing and movable along at least a portion of the channel between at least two switching positions for completing and breaking a circuit with the electrical contact means, the carriage comprising a guide track and also containing locking means adjacent one end of the guide track; and an actuator having complementary means for engagement with the locking means to fixedly attach the actuator with the movable carriage when engaged therewith, the actuator being movable along the track between a first, unlocked position in which said actuator is not coupled to said carriage and a second, engaged position at said one end of the guide track in which said actuator is fixedly coupled to said carriage and movement of said actuator thereafter causes corresponding movement of said carriage.

6. The switch of claim 5 wherein the actuator is substantially flush with an outer edge of the channel in the first position.

7. The switch of claim 6 wherein the actuator sufficiently extends past the outer edge of the channel in the second position to allow manual movement of the carriage by the finger of a human operator.

8. The switch of claim 5 wherein the locking means comprises at least one tang and the complementary means on the actuator comprises a recess of complementary shape engageable with the tang to form a snap fit connection.

9. The switch of claim 5 wherein the moveable carriage comprises a plurality of wiper contacts carried on the carriage and engageable with selected different ones of a plurality of contact pins which form the electrical contact means in the base of the housing.

10. The switch of claim 5 wherein the movable carriage is sealed from contamination entering the switch through the channel.

11. A switch, comprising:

a housing with a first surface containing a channel therethrough, and a base containing a plurality of contacts;

a carriage having a surface, the carriage being receivable within the housing and movable along at least a portion of the channel, the carriage containing wiper means for selectively bridging the contacts at different positions along its movable path, the carriage further including a ramp extending from a position below the surface of the carriage to a position adjacent the surface of the carriage;

an actuator movable along the ramp between a first uncoupled, position in which said actuator is substantially flush with the first surface of the housing and a second position along the ramp; and locking means on the carriage and the actuator to allow the actuator to be coupled to the carriage in the second position so that further movement of said actuator causes corresponding movement of said carriage between different switching positions.

12. The switch of claim 11 wherein the actuator sufficiently extends past the first surface of the housing to allow manual movement of the actuator along at least a portion of the channel by a finger of a human operator.

13. The switch of claim 11 wherein the locking means includes a locking tang on the ramp near the second position of the actuator, and the actuator has a locking face which snap fits over the locking tang in order to couple the actuator to the carriage.

14. The switch of claim 11 wherein the ramp is comprised of a pair of upwardly sloping tracks extending along the sides of an open channel through the carriage, the actuator including a central body having a pair of side flanges which engage the pair of actuator tracks to guide the actuator along the ramp and through the open channel into an extended position located at the top of the ramp.

15. The switch of claim 14 wherein the actuator further comprises an extending nose portion which extends under the surface of the carriage when the actuator is moved to the second position in order to support the actuator.

16. The switch of claim 14 wherein the actuator further includes an extending body which covers the opening of the open channel when the actuator is extended to the second position in order to minimize contamination and foreign objects from entering the carriage.

17. A switch, comprising:

a housing with a first surface containing an open channel therethrough, and a base containing a plurality of contacts;

a carriage moveable within the housing along at least a portion of the channel and containing wiper means for selectively bridging the plurality of contacts at different positions along its movable path, the carriage further including at least one angular wall extending at an angle to the first surface of the housing containing the channel;

an actuator having a button initially located at a position substantially flush with said first surface of the housing containing the channel, the actuator button containing a bearing surface which engages the angular wall and is movable therealong to a second position which causes the button to extend outwardly from said surface of the housing containing the channel; and locking means on the carriage and the actuator to cause the actuator to be locked into the second position so that further movement of the actuator button causes corresponding movement of the carriage between the different switching positions.

18. The switch of claim 17 wherein the housing contains a solid top wall and a side wall in which the channel is located, the carriage having a top surface on which the angular wall is located with the actuator button extending outwardly from the side wall of the housing.

19. The switch of claim 18 wherein the carriage has a solid top surface to seal the wiper means contained therein from contamination entering the housing through the open channel.

20. The switch of claim 17 wherein the carriage includes a second angular wall spaced from the first angular wall, the actuator button being movable between the first and second walls to move to the second position.

21. The switch of claim 20 wherein at least one of the first and second walls each contain a locking recess and the actuator contains a locking tab which snap fits over the locking recess to thereby form the locking means.

* * * * *